US008079324B2

(12) United States Patent
Meyer

(10) Patent No.: US 8,079,324 B2
(45) Date of Patent: Dec. 20, 2011

(54) DEVICE FOR LATER APPLICATION OF A TWO-COMPONENT MATERIAL ON A SUBSTRATE

(75) Inventor: Thomas Meyer, Hämikon (CH)

(73) Assignee: Robatech AG, Muri (CH)

( * ) Notice: Subject to any disclaimer, the term of this patent is extended or adjusted under 35 U.S.C. 154(b) by 858 days.

(21) Appl. No.: 12/091,015

(22) PCT Filed: Oct. 12, 2006

(86) PCT No.: PCT/EP2006/067310

§ 371 (c)(1),
(2), (4) Date: Apr. 21, 2008

(87) PCT Pub. No.: WO2007/045589

PCT Pub. Date: Apr. 26, 2007

(65) Prior Publication Data

US 2008/0271672 A1 Nov. 6, 2008

(30) Foreign Application Priority Data

Oct. 21, 2005 (EP) ..... 05109823

(51) Int. Cl.
*B05C 5/02* (2006.01)

(52) U.S. Cl. ..... 118/411; 118/412; 118/419; 118/429; 366/158.5; 366/181.5

(58) Field of Classification Search ..... 118/411, 118/412, 419, 429; 68/205 R; 425/133.5, 425/462, 204, 207, 378.1, 379.1, 381, 466, 425/465; 222/132, 135, 145.5, 145.6, 145.7, 222/146.6, 486, 559, 561; 239/597, 601, 239/407, 413, 427, 428, 128, 135; 366/96, 366/144, 158.5, 181.5

See application file for complete search history.

(56) References Cited

U.S. PATENT DOCUMENTS

| | | | | |
|---|---|---|---|---|
| 3,832,427 | A * | 8/1974 | Mutch | 264/39 |
| 5,075,139 | A * | 12/1991 | Crumbach et al. | 427/286 |
| 6,627,025 | B1 * | 9/2003 | Yu | 156/167 |
| 2005/0028938 | A1 * | 2/2005 | Hill | 156/548 |
| 2005/0136144 | A1 * | 6/2005 | Haynes et al. | 425/7 |

FOREIGN PATENT DOCUMENTS

JP 10-005663 * 1/1998

* cited by examiner

*Primary Examiner* — Laura Edwards

(74) *Attorney, Agent, or Firm* — Browdy and Neimark, PLLC

(57) ABSTRACT

A device for spreading a two-component coating material, including at least two components, on a flat web-shaped carrier includes a slotted nozzle provided with an output slot whose length defines the width of the coating material application to the carrier, wherein the slotted nozzle is provided with two end areas and a nozzle chamber which is arranged inside the slotted nozzle and extends in a parallel to the output slot from the first to the second end area. A first mixer is arranged in the region of the first end area. A second mixer is positioned in the region of the second end area. At least one first reservoir for the first component and at least one second reservoir for the second component are provided. A transport mechanism is used for individually transporting the first component from the first reservoir to the first and second mixers and for transporting the second component from the second reservoir to the first and second mixers.

11 Claims, 4 Drawing Sheets

DEVICE FOR LATER APPLICATION OF A TWO-COMPONENT MATERIAL ON A SUBSTRATE

FIELD OF THE INVENTION

The invention relates to a device for applying a material, which is capable of flowing, onto a substrate.

The present application claims the priority of the European patent application EP 05109823.4, which was filed on Oct. 21, 2005.

BACKGROUND OF THE INVENTION, PRIOR ART

There has been no reliable system for lateral application of materials produced by mixing two-components that cure relatively quickly after being mixed.

Above all, cleaning a system for applying such two-component materials is especially critical as the residues can only be removed with difficulty after curing.

Consequently, it is an object to develop a corresponding device that functions reliably on the one hand and is easy to use on the other.

A further object is seen to be to provide a device that is suitable for deployment in an industrial manufacturing setting.

SUMMARY OF THE INVENTION

The objective is achieved by a device in accordance with claim 1.

Further advantageous embodiments of the invention are provided in the dependent claims.

It is regarded to be a significant advantage of the invention that the components of the material to be applied are only mixed together spatially and temporally immediately before flowing out of a slot nozzle. The slot nozzle is constructed in such a manner that it has no undercuts, corners or edges in the region of the nozzle chamber. Furthermore, provision is made in one preferred embodiment for at least one cleaning element that can be displaced within the nozzle chamber so as to be able to remove the two-component material from the nozzle chamber.

One advantage of the invention is seen to be that the device functions on the first-in/first-out principle and can be operated for a protracted period without interruption. If cleaning is necessary, the cleaning element can be employed. Such cleaning is simple and work quickly. Therefore, loss of production is minimal.

In accordance with the invention it is possible to produce coatings of two-component material, or of materials with more than two-components, by dispensing the material in the desired thickness, width and length onto a passing substrate material.

A device in accordance with the invention is advantageous from an environmental technology point of view as it consumes less material than previously. Furthermore, a closed circulation of material can be achieved in which the material only exits at the nozzle and is only mixed from the components when required.

The process stability is improved and reproducibility is improved considerably in accordance with the invention. Furthermore, a device in accordance with the invention can be operated at higher speeds, resulting in a higher throughput.

A device in accordance with the invention can start up and stop much faster. The glue application is performed in a controlled manner. This dispenses with intermediate storage and other steps.

Furthermore, depending on the embodiment, the device in accordance with the invention is self-cleaning.

DRAWINGS

Further details and advantages of the invention shall be described in the following in detail with reference to exemplary embodiments and with some reference to the drawing. All the figures are schematic and not true to scale and the corresponding structural elements are indicated by the same reference symbols in the various figures, even if individual details of their design vary.

DETAILED DESCRIPTION OF THE EXEMPLARY EMBODIMENTS

The invention relates to a device to be used in the manufacture of coated substrates, with a (coating) material being used that comprises at least two components that harden relatively quickly after mixing. These materials shall hereinafter be referred to as two-component materials, with the option of being able to add further components and additives. Therefore, the term two-component material is used to describe materials, the components of which react with each other and harden after mixing.

Figure 1:
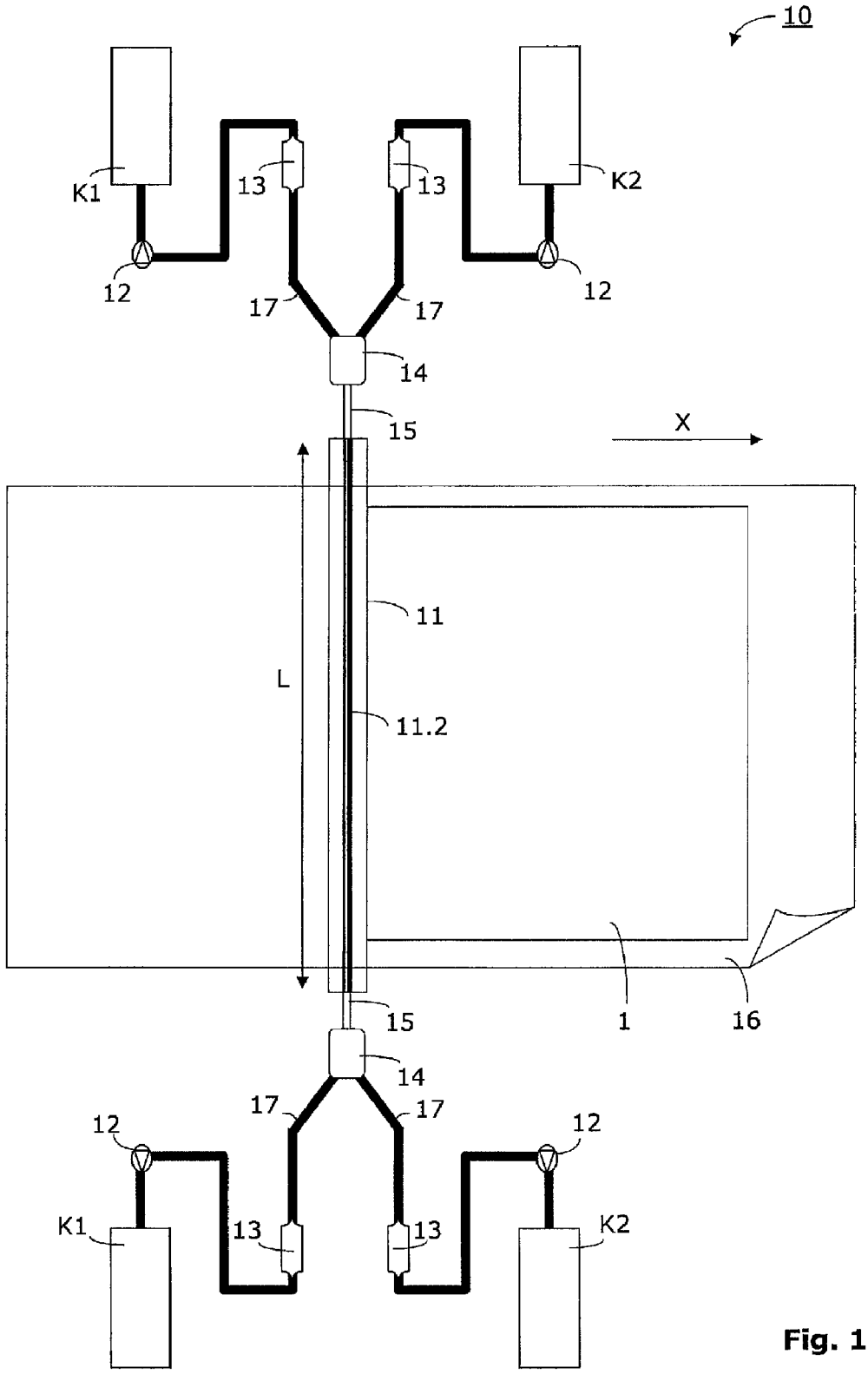
FIG. 1 shows a first embodiment of the invention in a highly schematic representation.

FIG. 1 shows a first device 10 in accordance with invention. The device 10 is designed especially for applying two-component materials onto the coating side of a substrate 16. The device 10 comprises one (slot) nozzle 11, which dispenses the liquid two-component material, while the coating side of the substrate 16 is transported at a distance A below the nozzle 11, as indicated by the arrow X. The distance A, with $A \geqq 0$ can be set such that the material 1 is laterally applied in an optimal manner. Highly preferable is an embodiment whereby the distance is $A=0$, with the nozzle 11 touching the substrate 16 (contact mode) accordingly. In this case the device 10 is designed in such a way that the gap between the substrate 16 (medium) and the nozzle 11 and therefore the pressure on the substrate can be finely adjusted.

However, in accordance with the invention it is also possible to allow the liquid two-component material, that is the mixed liquid, to flow between two substrates (media) without contact.

Furthermore, the device 10 is provided with at least two material tanks K1, K2, hereinafter referred to as reservoirs. In addition, provision is made for a conveying device that comprises the pumps 12 and an optional system for measuring and governing the flow that preferably comprises a flow regulator 13 and a control element to be able to measure and set the flow. The components of the material 1 are transported separately from each of the reservoirs K1, K2 to mixers 15 through the connection 17 shown in black. As indicated in FIG. 1, a mixer 15 is located at each end of the nozzle 11. In order to connect the connections 17 to the mixers 15, optional supply elements 14 can be employed. However, it is also possible to connect the connections 17 directly to the mixers 15. In order to ensure the fluidity of the components, in one highly preferred embodiment at least one of the connections is developed as a heatable hose or a heatable pipe.

The mixers 15 can also be developed to be heatable.

Figure 3:
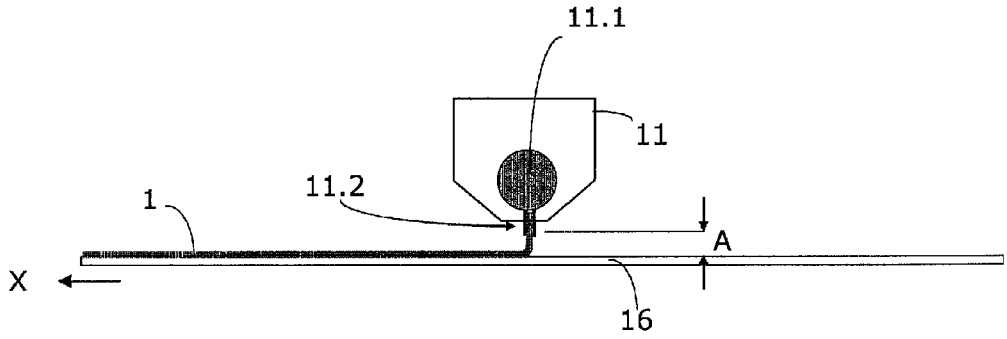
FIG. 3 shows part of a further embodiment of the invention in a side view.

One possible embodiment of the nozzle 11 is shown in FIG. 3 in a highly schematic cross-section. The two-component material enters the nozzle chamber 11.1 of the nozzle 11 from both ends symmetrically. The (slot) nozzle 11 shown is provided with an elongated outlet slot 11.2 facing the substrate 16. The elongated outlet slot 11.2, as well as the substrate 16, runs essentially perpendicular to the plane of projection in FIG. 3.

Figure 2:
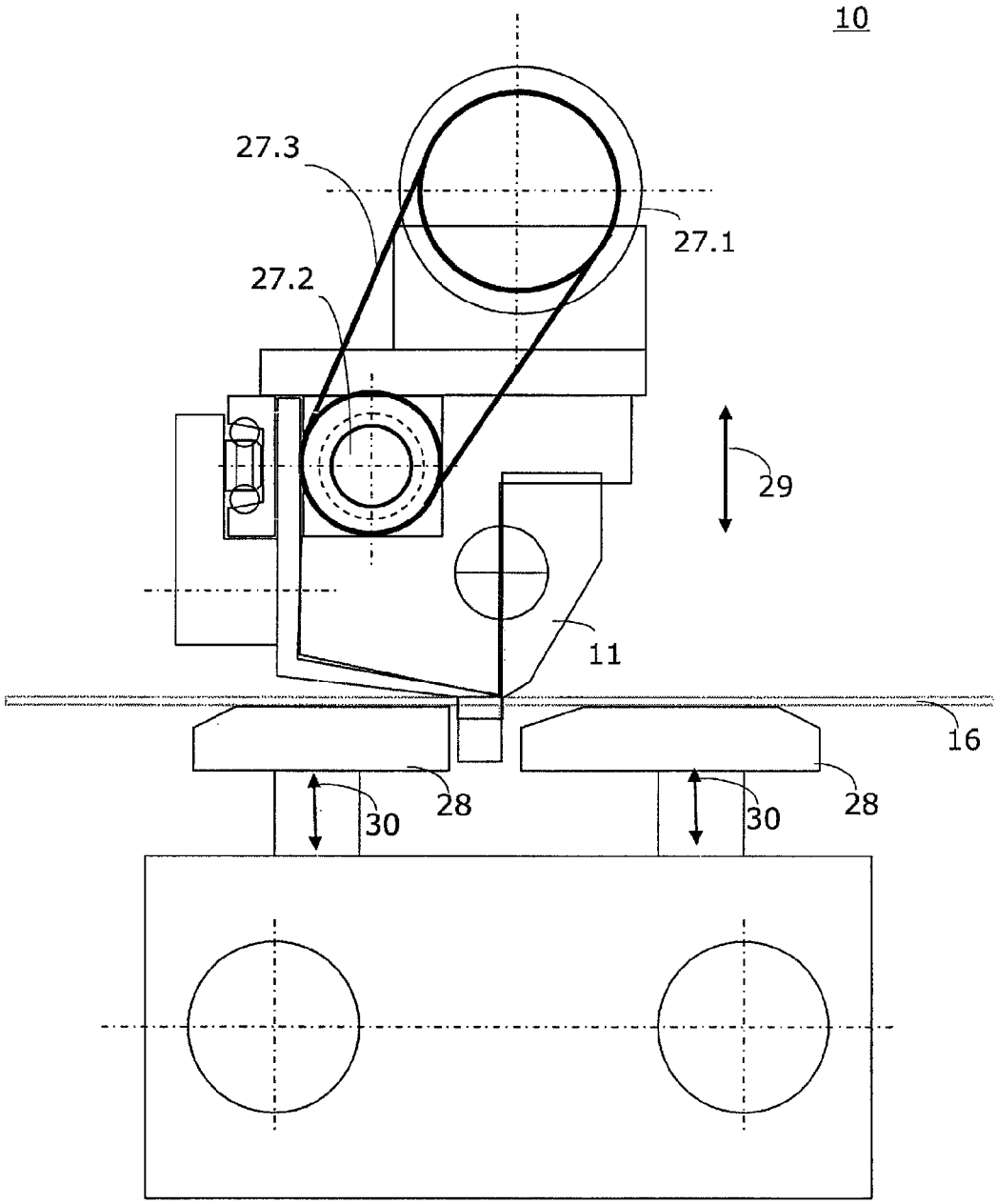
FIG. 2 shows a further embodiment of the invention in a side view.

FIG. 2 shows part of a further device 10 in accordance with the invention. This device is a so-called 'nozzle carriage', that can be employed on a production line for instance. The substrate 16 runs as a web across two plates 28 or suitable guide elements. The contact pressure of the plates 28 can be set by springs or hydraulic means as indicated in FIG. 2 by the double arrows 30. The actual nozzle 11 sits above the substrate 16. The nozzle 11 can be set by means of an adjustment mechanism. This setting can be used for instance to specify the relative position (distance A and/or the setting angle) of the nozzle 11 in relation to the substrate 16. Furthermore, provision can be made for means to mechanically set the width of the nozzle or the width of the nozzle outlet slot 11.2. Two wheels 27.1, 27.2 can be seen in FIG. 2 that are connected to each other by means of a belt 27.3. The width of the nozzle outlet slot 11.2 is set by means of a shaft or a plunger as a result of actuating the wheel 27.1. There are different approaches for setting the width of the nozzle outlet slot 11.2. The aforementioned shaft can for instance be mounted in a thread of the nozzle 11 in order to drive it in or out, depending on the direction of rotation, away from one or both ends of the nozzle 11 in the nozzle chamber 11.1. Depending on the position of the shaft, the nozzle chamber 11.1 is made larger or smaller, changing the effective working length L of the outlet slot 11.2. However, the shaft can also bear a sliding element 11.3 that is displaced by rotating the shaft in order to alter the outlet slot 11.2. A plunger can also be employed that can be displaced in the nozzle chamber 11.1 in order to adjust the nozzle outlet slot 11.2.

In one preferred embodiment the nozzle carriage can be moved up and down parallel to an axis 29 in order to set the distance A between the nozzle 11 and the substrate 16.

In addition, the nozzle carriage can preferably be adjusted at an angle W, with this setting angle lying between 0 and 20 degrees, preferably between 2 and 10 degrees. The nozzle 11 in FIG. 1 or the other embodiments can also be developed to be adjusted accordingly.

A further embodiment is shown in FIG. 3 in a highly schematic side view. The nozzle chamber 11.1 and the outlet slot 11.2 can be seen in the embodiment shown in a cross-section through the nozzle 11. Preferably, the nozzle chamber 11.1 has a circular or oval cross-section in all the embodiments in order to be able to move a piston-shaped element 11.3 (for cleaning and/or setting the effective length L of the outlet slot 11.2) in the nozzle chamber 11.1.

Preferably, a piston-shaped cleaning element is arranged inside the nozzle 11 that prevents the formation and/or collection of contamination by being moved back and forth manually or automatically by a motor in order to clean the nozzle chamber, preferably employing a screw with a recirculating ball nut and with the screw extending parallel to the output slot. Either two piston-shaped cleaning elements are employed that can be moved from right to left through the nozzle chamber towards the middle in order to transport contamination or depositions through the outlet slot 11.2 or a piston-shaped cleaning element can be employed in such a way that it travels through from one side of the nozzle chamber 11.1 and carries out contamination or depositions in the region of the opposite end of the nozzle chamber 11.1. In order to do so, the mixer 15 on the opposite side of the nozzle chamber 11.1 can for instance be temporarily removed. In this way the nozzle chamber 11.1 can be cleaned quickly and completely.

Figure 4A:
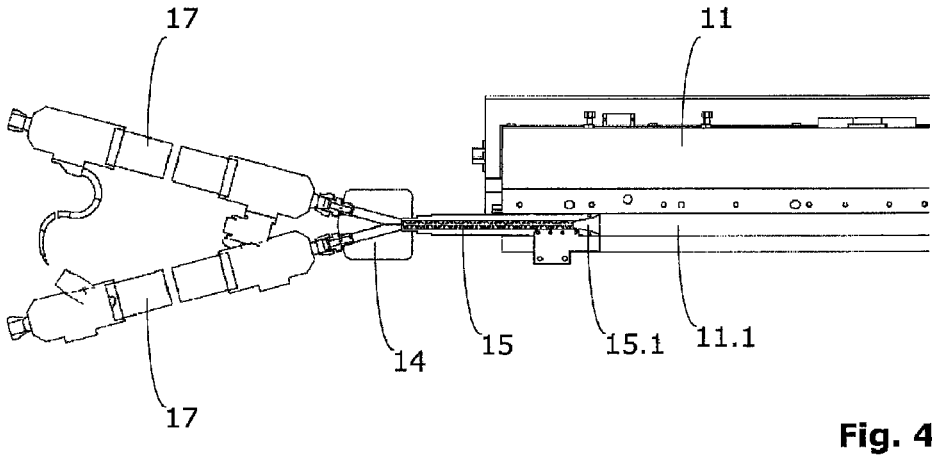
FIG. 4A shows part of a further embodiment of the invention in a top view.
Figure 4B:
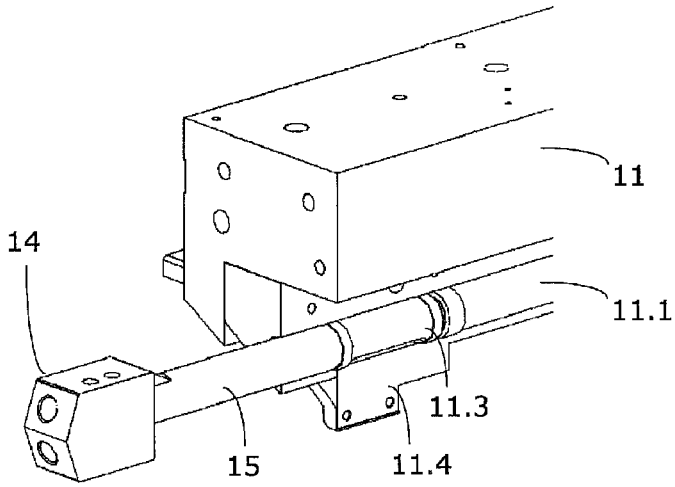
FIG. 4B shows part of a further embodiment of the invention in a detailed view.

FIG. 4A shows a schematic cross-sectional view of an end zone of a nozzle 11 with mixer 15, connecting element 14 and two heatable hoses 17. Preferably, static mixers 15 are employed that mix the two or more components together after their entry. In the embodiment shown, the mixer 15 feeds directly into the nozzle chamber 11.1. Preferably, a transition piece 15.1 is arranged between the mixer 15 and the nozzle chamber 11.1 that ensures a transition free of undercuts in order to prevent the deposition of residual material. Further details of this embodiment can be observed in FIG. 4B. The second half of the nozzle chamber 11.1 is open and a piston-shaped, displaceable element 11.3 is visible that can be employed to adjust the nozzle width L and/or for cleaning. The vane 11.4 shown can be displaced into the outlet slot 11.2 of the nozzle 11. Displacing the vane 11.4 also moves the piston shaped element 11.3.

In accordance with the invention a static mixer comprises an elongated insert to longitudinally homogenize two-component systems when passed through the mixer 15. Such a static mixer typically comprises an insert made of plastic or metal. During mixing (also called homogenizing) the two-components are brought together and they begin to react (cure).

The devices 10 in accordance with the invention can be operated in two different operating modes (non-contact mode and contact mode) depending upon the requirement. An embodiment can be developed either so that it is possible to switch it from one mode to the other or the embodiment can be developed especially for one of the two modes.

In accordance with invention, the material 1 enters the nozzle chamber 11.1 symmetrically from both sides after mixing and distributes itself in the chamber 11.1 toward the middle of the nozzle 11. This ensures that the material mixed first also leaves the nozzle chamber 11.1 first (first-in/first-out principle). This also ensures that the material 1 is spread evenly over the surface.

Figure 5:
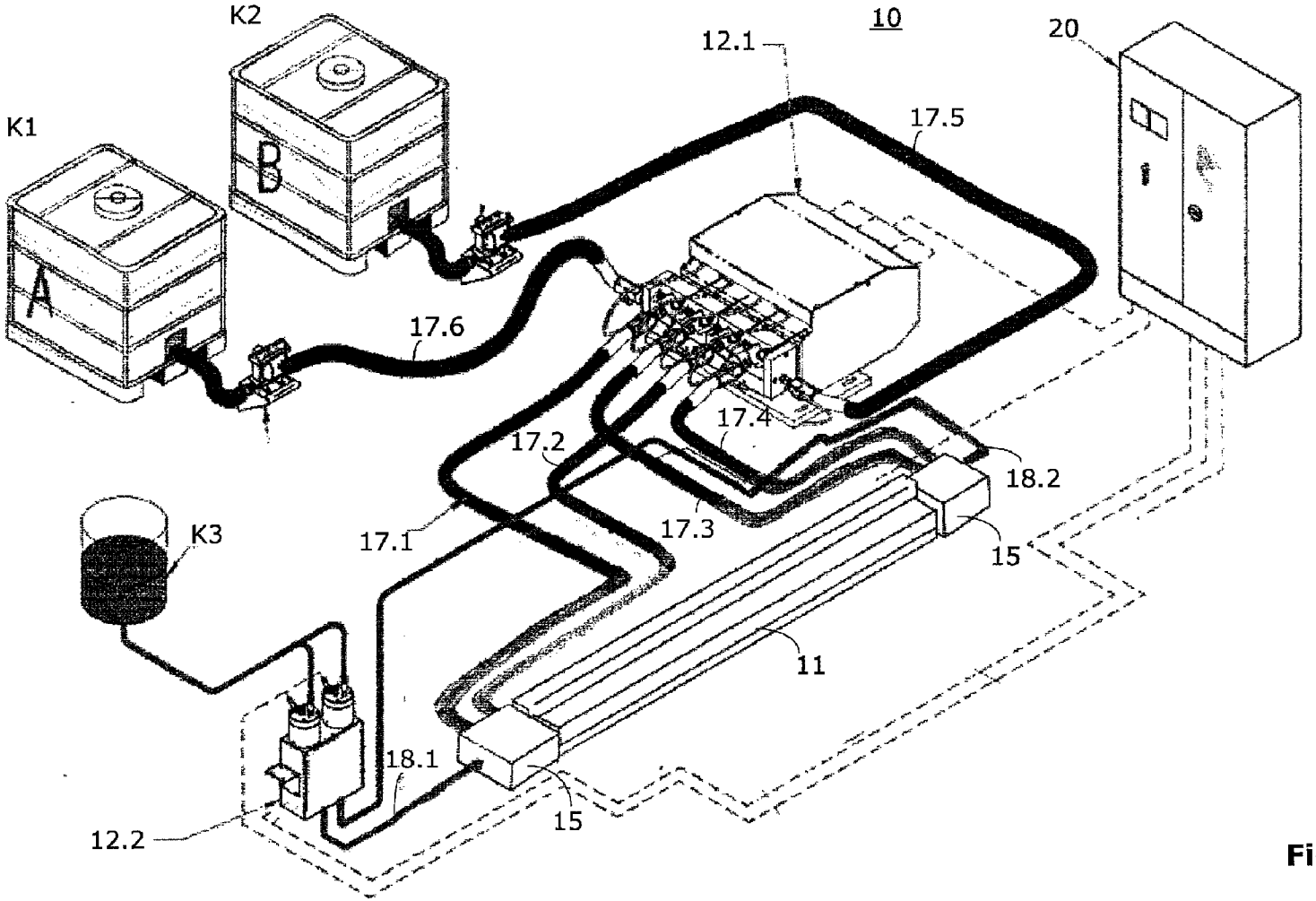
FIG. 5 shows a further embodiment of the invention.

FIG. 5 shows a further embodiment. Provision is made for three reservoirs K1, K2 and K3, with reservoir K3 containing a pigment that is fed into the mixer 15 by a pump 12.2 and via connections 18.1. The two other components A and B are transported separately from the reservoirs K1, K2 via connections 17.5, 17.6 into the pumping station 12.1 and fed from there to the mixers 15 via individual connections 17.1, 17.2, 17.3 and 17.4. These (static) mixers 15 are fastened directly to the nozzle 11. The three components are only mixed when in the mixers 15.

A device 10 in accordance with the invention can be equipped with different control and monitoring elements in order to monitor the method in accordance with the invention. A switch cabinet 20 with the corresponding elements is outlined in FIG. 5. The electrical lines are indicated in FIG. 5 by the broken lines.

In a preferred arrangement, an ionization rod or similar is arranged parallel to the nozzle 11 in order to be able to influence/divert the film of two-component material 1 after it leaves the outlet slot 11.2. Appropriate charging of the ionization rod can for instance attract the film of two-component material 1 and thereby influencing it.

In accordance with the invention, the nozzle 11 can be provided with cleaning lips or other cleaning elements. These lips or elements can be employed to clean the nozzles 11 as there can be contamination from inside (from hardened two-component material) and from outside. Lips can also be arranged in the region of the outlet slot 11.2 that allow the film of two-component material to be scraped off when the substrate 16 is touched or approached. These lips can be flexible. These lips can also be trailing.

Preferably, a piston-shaped cleaning element is arranged inside the nozzle 11 that prevents the formation and/or collection of contamination by being moved back and forth manually or automatically by a motor in order to clean the nozzle chamber, preferably employing a screw with a re-circulating ball nut and with the screw extending parallel to the output slot. Either two piston-shaped cleaning elements are employed that can be moved from right to left through the nozzle chamber towards the middle in order to transport contamination or depositions through the outlet slot 11.2 or a piston-shaped cleaning element can be employed in such a way that it travels through from one side of the nozzle chamber 11.1 and carries out contamination or depositions in the region of the opposite end of the nozzle chamber 11.1. In order to do so, the mixer 15 on the opposite side of the nozzle chamber 11.1 can for instance be temporarily removed. In this way the nozzle chamber 11.1 can be cleaned quickly and completely.

Preferably, the nozzle 11 is arranged so that the distance A to the substrate 16 is essentially the same across the entire length L (see FIG. 1) of the outlet slot 11.2.

As described farther above, it is preferable when the nozzle 11 can be positioned at an angle. In this way, the two-component material is scraped off or applied at an angle.

The substrate 16 can be moved past the nozzle of the devices in accordance with the invention either as a continuous web or in the form of sheets of substrate material. It is also feasible to move the nozzle 11 past the substrate 16.

In a further embodiment the device 10 comprises means for applying another layer to the substrate 16 with the two-component material in order to create a sandwich structure.

In a preferred embodiment a self-cleaning nozzle 11 is employed. The self-cleaning nozzle 11 can be provided for instance with a cleaning lip, cleaning elements or similar, as described.

In accordance with the invention the distance A can be set manually or by means of a motor, depending on the embodiment. Embodiments are preferred that operate in the contact mode (A=0) and which allow manual or motorized fine adjustment.

Preferably, the device 10 in accordance with the invention can be provided with means to apply component material intermittently, with the means preferably provided with a controlled lip or a controlled slider for interrupting the film of two-component material emerging from the output slot 11.2 or to influence the quantity of two-component material emerging. Preferably, this influence occurs synchronously with the substrate 16 moving past. Such synchronization can be achieved by employing optical scanning of the substrate 16.

Preferably, the device 10 is provided with a two-component material distributor 12.1 in order to deliver the two-component material evenly (in relation to the length L) into the nozzle 11 from both ends.

Depending on the embodiment, the present invention makes it possible to achieve two-component material application quantities between 1 g/m$^2$ und 999 g/m$^2$. Preferably, the two-component material application quantity is set between 20 g/m$^2$ und 300 g/m$^2$.

Depending on the embodiment, the present invention allows the substrate 16 to be transported past the nozzle 11 at a speed between 1 m/min and 150 m/min, preferably at a speed between 5 m/min and 30 m/min.

Preferably, the device 10 is provided with an automatic thickness adjustment in order to move the nozzle 11 to a prescribed distance A, depending on thickness of the substrate 16.

The invention claimed is:

1. Device for applying a coating material, which is capable of flowing and which comprises a first component and a second component, onto a flat, web-shaped substrate, the device comprising:

a slot nozzle with an output slot, having a length defining an application width of the coating material on the substrate, with the slot nozzle having two end zones and a nozzle chamber within the slot nozzle that extends parallel to the output slot from a first end zone to the second end zone, a first mixer arranged in the region of the first end zone, a second mixer arranged in the region of the second end zone, at least one first reservoir for the first component, at least one second reservoir for the second component, means of conveying for separately transporting the first component from the first reservoir into the first mixer and into the second mixer and for separately transporting the second component from the second reservoir into the first mixer and into the second mixer.

2. Device according to claim 1, wherein the slot nozzle is arranged so that a distance to the substrate is essentially the same across the entire length of the output slot.

3. Device according to claim 1, wherein the means of conveying for each component and reservoir comprise a pump and a heatable hose in order to transport the two-components separately and continuously from the reservoirs into the slot nozzle and to issue it from there onto the substrate as a continuous film of coating material.

4. Device in accordance with claim 1, wherein the slot nozzle comprises two piston-like cleaning elements that are mounted in the nozzle chamber in such a way that they can move from the end zones towards each other in the nozzle chamber.

5. Device in accordance with claim 4, wherein the cleaning elements can be displaced manually or by a motor in order to clean the nozzle chamber.

6. Device in accordance with claim 5, wherein the cleaning members are displaced by a motor by employing a screw with a re-circulating ball nut and with the screw extending parallel to the output slot.

7. Device in accordance with claim 1, wherein the slot nozzle comprises a piston-like cleaning element that is mounted in the nozzle chamber in such a way that it can move from one of the end zones to the other end zone in the nozzle chamber.

8. Device in accordance with claim 1, wherein the application width of the slot nozzle can be adjusted from both end zones symmetrically using a controlled lip or a controlled slider.

9. Device in accordance with claim 1, wherein the means of conveying are provided with a flow regulator and controller in order to influence the output of the coating material.

10. Device in accordance with claim 1, wherein the mixers are static mixers.

11. Device in accordance with claim 10, wherein the mixers are arranged directly at the end zones of the slot nozzle.

* * * * *